US009815097B2

(12) United States Patent
Juliette et al.

(10) Patent No.: US 9,815,097 B2
(45) Date of Patent: Nov. 14, 2017

(54) METHOD FOR CLEANING A (METH)ACRYLATE ESTER PROCESS TANK

(75) Inventors: Jamie J. Juliette, Houston, TX (US); Philippe P. Maillot, Kingwood, TX (US); Joy L. Mendoza, Seabrook, TX (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 14/344,470

(22) PCT Filed: Sep. 13, 2012

(86) PCT No.: PCT/US2012/055025

§ 371 (c)(1), (2), (4) Date: Mar. 12, 2014

(87) PCT Pub. No.: WO2013/048749

PCT Pub. Date: Apr. 4, 2013

(65) Prior Publication Data

US 2014/0338704 A1 Nov. 20, 2014

Related U.S. Application Data

(60) Provisional application No. 61/539,654, filed on Sep. 27, 2011.

(51) Int. Cl.

| | |
|---|---|
| ***B08B 9/00*** | (2006.01) |
| ***B08B 9/08*** | (2006.01) |
| ***B08B 9/093*** | (2006.01) |
| ***C11D 7/50*** | (2006.01) |
| *B08B 3/00* | (2006.01) |
| *B08B 3/02* | (2006.01) |

(Continued)

(52) U.S. Cl.

CPC ..... *B08B 9/08* (2013.01); *B08B 9/0933* (2013.01); *C11D 7/5022* (2013.01); *B08B 3/00* (2013.01); *B08B 3/02* (2013.01); *B08B 3/04* (2013.01); *B08B 9/00* (2013.01); *B08B 9/02* (2013.01); *B08B 9/027* (2013.01); *B08B 9/0804* (2013.01); *B08B 9/0808* (2013.01); *B08B 9/0813* (2013.01); *B08B 9/0817* (2013.01)

(58) Field of Classification Search

CPC .... B08B 3/00; B08B 3/02; B08B 3/04; B08B 9/00; B08B 9/02; B08B 9/027; B08B 9/08; B08B 9/0804; B08B 9/0808; B08B 9/0813; B08B 9/0817

See application file for complete search history.

(56) References Cited

U.S. PATENT DOCUMENTS 3,669,740 A * 6/1972 Yamamoto et al. . C08G 85/008 134/22.19
4,199,469 A * 4/1980 Walzer ..... C02F 5/105 134/24

(Continued)

FOREIGN PATENT DOCUMENTS

EP 1033359 A2 9/2000

*Primary Examiner* — Bibi Carrillo
(74) *Attorney, Agent, or Firm* — Husch Blackwell LLP

(57) ABSTRACT

Provided is a method for removing deposited solid residue from equipment used in the processing of (meth)acrylic acid or esters, including the steps of dissolving the solid residue in a cleaning solution comprising an organic carboxylic acid to produce a solid residue slurry; and removing the solid residue slurry from the equipment.

14 Claims, 5 Drawing Sheets

(51) Int. Cl.

| | |
|---|---|
| *B08B 3/04* | (2006.01) |
| *B08B 9/02* | (2006.01) |
| *B08B 9/027* | (2006.01) |

(56) References Cited

U.S. PATENT DOCUMENTS

| | | | | |
|---|---|---|---|---|
| 4,357,175 | A | 11/1982 | Buffington et al. | |
| 4,529,816 | A | 7/1985 | Decolibus et al. | |
| 4,731,126 | A * | 3/1988 | Dixit | C11D 7/265 134/19 |
| 5,085,710 | A | 2/1992 | Goss | |
| 5,204,026 | A * | 4/1993 | Doscher-Good | C09D 9/005 134/31 |
| 5,393,918 | A | 2/1995 | Dobson | |
| 5,580,391 | A | 12/1996 | Franco et al. | |
| 5,609,693 | A * | 3/1997 | Dobrez | B08B 3/08 134/18 |
| 6,180,819 | B1 | 1/2001 | Bauer, Jr. et al. | |
| 6,482,976 | B1 | 11/2002 | Ho et al. | |
| 6,722,377 | B1 | 4/2004 | Bruce et al. | |
| 7,073,519 | B2 | 7/2006 | Choi et al. | |
| 7,166,741 | B2 | 1/2007 | Yada et al. | |
| 7,319,162 | B2 | 1/2008 | Yada et al. | |
| 7,331,354 | B2 | 2/2008 | Schroeder et al. | |
| 2002/0183235 | A1 * | 12/2002 | Sprague | C11D 7/10 510/488 |
| 2005/0115590 | A1 | 6/2005 | Schroeder et al. | |
| 2005/0202989 | A1 * | 9/2005 | Wilson | C11D 11/0041 510/245 |
| 2006/0042661 | A1 | 3/2006 | Meyer et al. | |
| 2009/0071510 | A1 | 3/2009 | Hancock | |
| 2010/0069594 | A1 | 3/2010 | Gropp et al. | |
| 2011/0140050 | A1 | 6/2011 | Lipowsky et al. | |
| 2011/0315798 | A1 | 12/2011 | Hancock | |
| 2014/0338704 | A1 * | 11/2014 | Juliette | B08B 9/08 134/22.1 |
| 2015/0075561 | A1 * | 3/2015 | Dorton | C11D 7/5027 134/10 |

* cited by examiner

METHOD FOR CLEANING A (METH)ACRYLATE ESTER PROCESS TANK

CROSS REFERENCE TO RELATED APPLICATION

The present application is the national phase of PCT Patent Application No. PCT/US2012/055025 filed Sep. 13, 2012, which claims priority to U.S. provisional Application No. 61/539,654, filed Sep. 27, 2011, the entire content of which is incorporated by refrence herin.

BACKGROUND

This invention relates to a method for cleaning storage tanks used in the preparation of unsaturated carboxylic acids and their esters.

Unsaturated carboxylic acids and esters of the acrylic acid or methacrylic acid type are currently prepared industrially by heterogeneously catalyzed gas-phase oxidation of the corresponding alkenes, alkanes or unsaturated aldehydes or from the reaction of sulfuric acids and acetone cyanohydrin. Typically, to avoid polymerization during the generation of the desired product, stabilizers such as phenothiazine (PTZ) hydroquinone methyl ether (MeHQ), hydroquinone (HQ), alky and aryl substituted-phenylene diamine derivatives are used. Nevertheless, undesired polymer formation occurs and deposits on the reactors, distillation and rectifying columns, separators and product and intermediate product storage tanks.

The presence of the undesirable solid residue in the storage tanks can lead to contamination in the feed lines along with the downstream equipment causing fouling and inoperability which can greatly affect heat exchangers and reboilers and distillation column efficiencies. Removal of the storage tanks from service for cleaning can be especially expensive and logistically difficult where these tanks are typically used as the bulk material storage during a prolonged shut-down when the plant is being cleaned. In some cases, cleaning and shutdown of the tanks may well require a complete facility shutdown. In the case of unsaturated organic acids and esters the materials are not only flammable and hazardous, they are also difficult to transfer due to the nature of the undesirable polymeric solid residue which typically includes high molecular weight solids. Therefore, it becomes especially important that the storage tank cleanings be done as efficiently and expediently as possible, while maintaining a simple and reliable cleaning method.

U.S. Pat. No. 7,331,354 is directed to a method for cleaning equipment used in the production of methacrylic acid or esters by using a basic liquid. The liquid used for the cleaning process is an aqueous alkali metal and/or alkaline earth metal hydroxide and/or oxide solution, particularly an aqueous solution of NaOH, KOH or $Ca(OH)_2$. The aqueous solution has a dissolved salt content from 0.01 to 30% by weight. However, the use of caustics in a cleaning process is not ideal and may lead to contamination of equipment downstream.

A need exists for an efficient, caustic-free cleaning method for removing solid residue deposited on equipment used in the production of methyl methacrylate (MMA) which takes into account material cost, ease of handling, disposal, and practicality.

SUMMARY

In one embodiment the invention is a method for removing solid residue from equipment used in the processing of (meth)acrylic acid or esters, comprising the steps of dissolving the solid residue in a cleaning solution comprising an organic carboxylic acid having 2-10 carbon atoms to produce a solid residue slurry and removing the solid residue slurry from the equipment.

DETAILED DESCRIPTION

Figure 1:
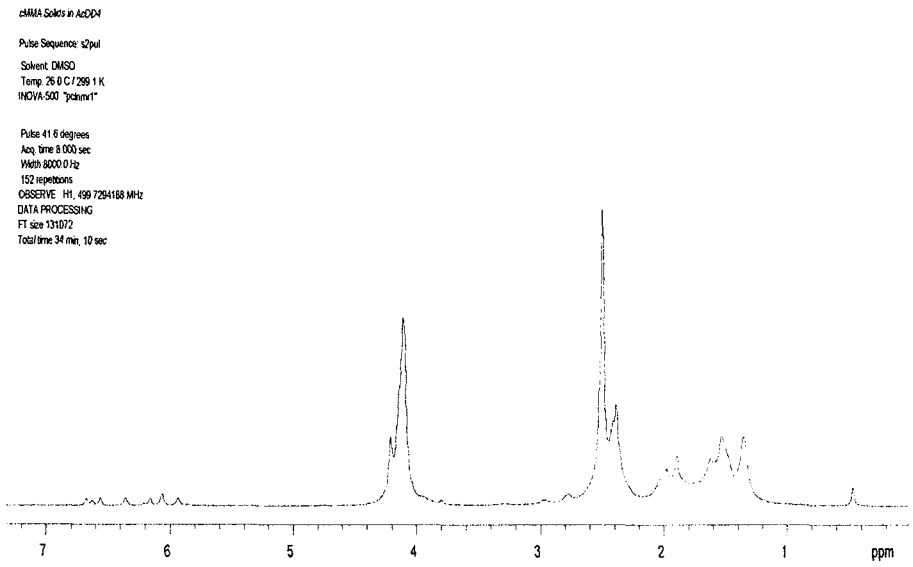
FIG. 1 is an $^1H$ NMR spectrum of solid residue collected from a MMA plant.

The present disclosure provides a method for cleaning the solid residue formed in equipment used in producing (meth) acrylic acid or esters by removing the solid residue in a simple and inexpensive manner and without requiring extensive mechanical or manual labor, high pressure or temperatures, or caustic materials.

In an embodiment, the invention relates to a method for cleaning solid residue from equipment used in the processing of methyl methacrylate (MMA), including the steps of dissolving the solid residue in a cleaning solution comprising a $C_2$-$C_{10}$ organic acid to produce a solid residue slurry, and removing the solid residue slurry from the equipment.

The cleaning solution comprises an organic carboxylic acid (organic acid) having one to ten carbon atoms ($C_1$-$C_{10}$, preferably two to three carbon atoms ($C_2$-$C_3$) and most preferably two carbon atoms ($C_2$). In the case where residual water may be present in the facility parts, e.g., storage tank, the cleaning solution may comprise the corresponding organic acid anhydride along with the organic carboxylic acid whereby the anhydride may be converted to the organic carboxylic acid during the dissolution. Particularly suitable are cleaning solutions comprising acetic acid, propionic acid and their corresponding anhydrides. In an embodiment, the cleaning solution has a pKa from 3 to 7.

In an embodiment, the cleaning solution is acetic acid or propionic acid, which may be used as a pure solution. Typically, the cleaning solution has a concentration of 90 to 95% acetic acid or propionic acid in water.

The acetic acid or propionic acid used may be obtained from an acetic acid process or as the by-product of an integrated acrylic acid or methacrylic acid process, where the $C_2$ or $C_3$ organic acid is typically obtained as an undesired material. The acetic acid by-product solution may well contain other materials from an integrated acrylic process, such as acrylic acid, and other by products such as methylethylketone. Typically, the acetic acid by-product solution comprises 3-5 wt % of acrylic acid and 1-2 wt % of water.

The temperatures at which the dissolving and removing of solid residue in the cleaning solution are carried out are determined by the boiling points of the organic acidic solvents. For example, for acetic acid temperatures used are below 118° C. and for propionic acid the temperature is below 141° C. In the case of rectification equipment, reactors and separators which can be isolated and closed, increased temperatures and pressures may be used. In the case of other facility equipment, including product and intermediate product storage tanks with removable roofs and metallurgies that are incompatible with organic acids and high temperatures, relatively mild temperatures are used, preferably less 50° C., most preferably ambient conditions (i.e., room temperaure and atmospheric pressure). In the case of facility equipment made of stainless steels and carbon steels, it is found the $C_2$ and $C_3$ acids may be used as the cleaning solution of choice so long as the residence time is kept at such rates so as to reduce the possibility of deleterious corrosion.

In an embodiment, relating to the cleaning of a storage tank, the method of removing the solid residue includes pumping enough of the cleaning solution into the tank to cover the solid residue built up on the bottom of the tank. The cleaning solution is added to the solid residue remaining in the storage tank in a ratio of greater than zero to 1 up to a ratio of 10:1 (weight ratio of cleaning solution to estimate of solid residue), preferably 1:1, and most preferably 2:1. The cleaning solution may be applied to the solid residue by simply pumping in the cleaning solution into the tank, spraying the cleaning solution along the walls of the tank, or by other methods known in the art.

After 24-48 hours, the resulting solid residue slurry is pumped out of the tank and typically disposed of. The process can be repeated until the solid residue is removed from the tank. Complete removal of the solid residue is determined by examining the exiting solution of comprising the cleaning solution with the dissolved solid residue such that it is clear or near clear, either by visual inspection or by quantitative measurement, such as varnish color scale (VCS) or ASTM D1209. There are various alternative methods of determining when the tank is clean and no longer needs cleaning solution added or circulated. In one embodiment, the viscosity of the exiting solution is monitored to determine when the tank is sufficiently clean of the solid residue. In one embodiment, an X-ray is taken of the tank to determine the thickness of the solid residue still remaining on the bottom of the tank. The X-ray can be compared to an original X-ray of the tank taken before the tank is used for comparison. For more portable equipment, the weight of the equipment can be used to determine when the solid residue is fully removed, i.e., when the equipment returns to its original weight then the equipment is free from solid residue.

In an embodiment of the invention, dissolving the solid residue may be accomplished with agitation or by simple contact. The method for removing the solid residue may involve the use of a process tank feed and exit lines to induce circulation in the product and intermediate product storage tanks in a manner to increase the overall solubilization time.

In an embodiment, the solid residue dissolved in the cleaning solution may be used as fuel, i.e., a carbon source, for burning in a furnace.

Definitions

Unless stated to the contrary, implicit from the context, or customary in the art, all parts and percents are based on weight and all test methods are current as of the filing date of this disclosure. For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weights, etc., is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the ratios of solvent to material being cleaned.

"(Meth)acrylic acid or esters" refers to acrylic acid, acrylic acid esters, methacrylic acid, methyl methacrylic acid esters or a combination thereof.

"Solid residue" and like terms refers to the products or by-products of processes for the manufacture of (meth) acrylic acid or ester that remains in or on the equipment used in the manufacture of (meth)acrylic acid or ester including polymeric and oligomeric materials in the form of solids at ambient conditions (25° C. at atmospheric pressure), sludge, and amorphous materials.

"Solid residue slurry" refers to a solution produced from the combination of the cleaning solution and the solid residue in which a majority of the solid residue is dissolved into the cleaning solution and creates a solution that can be removed by simply pumping the solution out of the storage tank.

"Equipment" refers to any object used during the manufacture of (meth)acrylic acid or ester that includes, but is not limited to, storage tanks, distillation columns, extractors, mixers, heat exchangers, condensers, condensate tanks, feed and transfer lines, separators and the like.

EXAMPLES

Solvent Experiments

Materials

Representative solid residue of unsaturated acid ester as exemplified in a crude MMA product storage tank is obtained from the strainer from the discharge of a pump. The solid residue is vacuumed filtered using an aspirator. The black-brown rubbery solid is collected from the filter and air dried for 6-8 hours in which time the solid residue changes from a rubbery material into a hard, crushable material. The resulting solid is used in the solubility examples. All the solvents used below are available from Aldrich Chemical Company, except for the 10% NaOH which is obtained from Fisher Chemical Company.

Solubility Examples

Solvents of acetic acid, acetone, methyl sulfoxide (DMSO), ethyl alcohol methyl alcohol, acetonitrile, ethylene glycol, 2-propanol (isopropanol), aqueous sodium hydroxide and N-methylpyrrolidone (NMP) and mixtures thereof are examined as cleaning solutions used to remove solid residue from equipment used in the preparation of MMA. One gram of the solid residue and three grams of the particular solvent are combined in test tubes and allowed to sit overnight. In the solvent experiments, agitation is purposefully excluded because it may not be available for use in a large storage tank.

Cleaning solutions which include organic acid result in the best solubilization of the undesired solid residue. After 24 hours, all of the solid residue is found to have either swelled or remained insoluble except for the sample which uses acetic acid, which surprisingly appears as a slurry that is flowable when the test tube is tilted.

Interestingly, aqueous solutions of sodium hydroxide are found to not be effective in dissolving sludge/polymeric solids obtained from a typical integrated MMA process. Hydrolysis of the methyl esters to the corresponding and likely soluble carboxylate salt is sufficiently slow such that after more than 2 months at room temperature, a solution of 25% caustic and the polymeric solid residue remains primarily undissolved.

Dissolution screening experiments use from a 3-fold excess to a less than 1:1 (cleaning solution:solid residue) ratio. The 3-fold excess represents a practical limit given the size and quantity of solid residue that could be present. For example, in a typical storage tank of dimension in the range of 18 meters (m) diameter and 12 m high and after several years of operation the level of solid residue and sludge in the bottom of the tank may be at least 1 m high. Therefore, there is a potential large volume of cleaning solution needed for dissolution.

Acetic Acid By-product Solution Experiments

Materials

Acetic acid as a crude product obtained from an integrated acrylic acid purification unit is used as obtained. Solid residue is obtained from a strainer from a discharge of a pump of a crude MMA product storage tank.

FIG. 1 is a $^{1}$H Nuclear Magnetic Resonance (NMR) spectrum of the solid residue obtained from the strainer. The solid is dried and the NMR sample is prepared in deuterated acetic acid. The spectrum shows signals typical of a methacrylate polymer backbone with strong methyl and methylene resonances at 1.2-2.3 parts per million (ppm). The strong methoxy resonances of the methyl esters are peaks at 4.15 ppm. Of interest are the peaks seen in the aromatic region from 5.9 and 6.8 ppm, likely attributable to aromatic protons of the process diphenyldiamine based inhibitors used.

Figure 2:
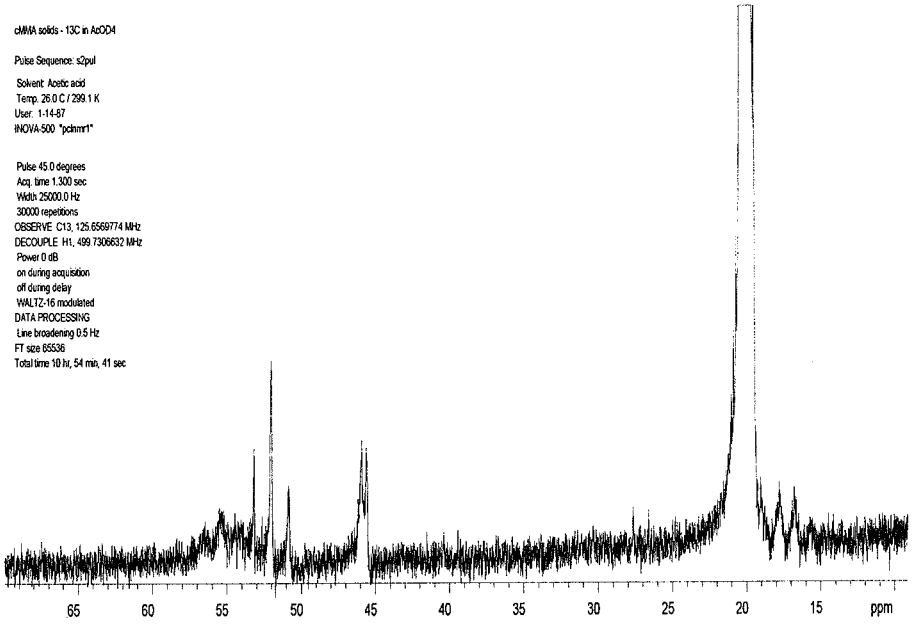
FIG. 2 is an expansion of the $^1H$ NMR spectrum of FIG. 1.

FIG. 2 is an expansion of the $^{1}$H NMR of FIG. 1 illustrating the methylene backbone (52 ppm) of the polymer and the alkyl methyls (17 and 19 ppm).

Procedure

A 32 ounce jar is charged with 175 g of solid residue obtained from the strainers without drying, followed by 350 g of acetic acid. The combined mixture is allowed to sit without application of mechanical agitation overnight where upon further examination showed that significant amounts of the solids had dissolved. The mixture is left standing further and after 24 hours, agitation and inversion of the container showed that the solids had been solubilized in acetic acid.

Examples 1-4 and Comparative Example 1

Figure 3:
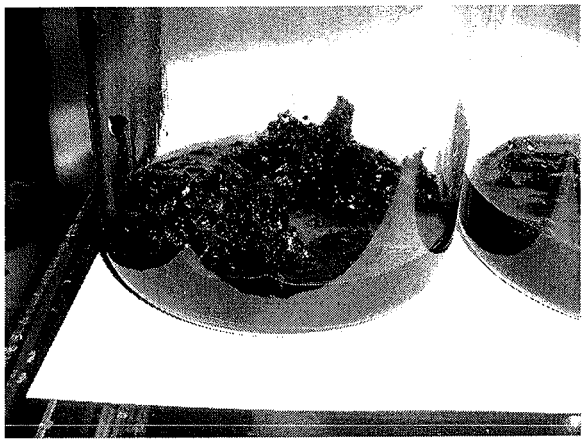
FIG. 3 is a photo of Example 1.

Example 1: A 16-ounce jar is charged with 1 wt equivalent of the solid residue (28.1 g) followed by 1 wt equivalent of acetic acid (28.2 g). The contents are stored at room temperature. After 24 hours, the resulting slurry shows that most of the solid residue is solubilized but a significant portion still remains. FIG. 3 is a photo of Example 1 upon addition of the cleaning solution.

Example 2: A 16-ounce jar is charged with 1 wt equivalent of the solid residue (21.5 g) followed by 2 wt equivalent of acetic acid (44.3 g). The contents are stored at room temperature. After 4-6 hours the mixture was an effective sludge that appears to be pumpable based on the movement of the mixtures when the container is tilted. After 24 hours, no visible solid residue is seen in the mixture.

Example 3: A 16-ounce jar is charged with 1 wt equivalent of the solid residue (28.3) followed by 3 wt equivalent of acetic acid (83.4 g). The contents are stored at room temperature. The mixture was a flowing slurry after less than 4 hours. After 24 hours, no visible solid residue is seen in the mixture.

Example 4: A 16-ounce jar containing a slurried mixture of 1 wt equivalent of the solid residue and 1 wt equivalent acetic acid solution is placed in a water bath at 59° C.±1° C. The mixture is initially not very flowable and maintained a thick consistency, similar to the example shown above. The flask is kept still with no agitation. After 30 min, the container is lifted from the bath and is found to move freely in the jar as a homogeneous mixture. The jar is tilted and rotated without any signs of insoluble material.

Figure 4:
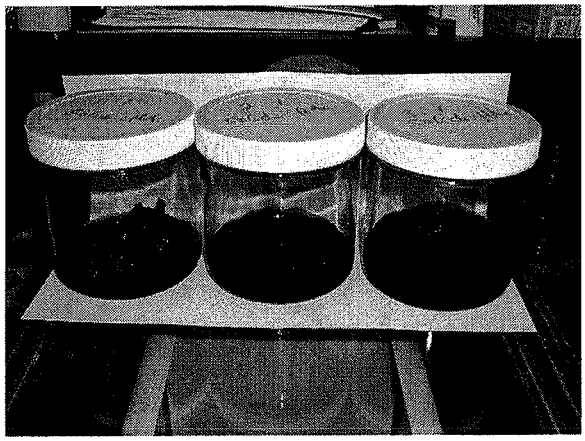
FIG. 4 is a photo of Examples 1-3.

FIG. 4 is a photo of Examples 1-3 (Example 1 is on the left, Example 2 is in the middle, and Example 3 is on the right from the observer's point of view) taken within 15 minutes from the addition of the cleaning solution.

In Comparative Example 1, 5.0 g of solid residue is added to an 8-ounce jar. Then 25 g of a 15% caustic solution made from 15 g of sodium hydroxide dissolved in 100 g of water is added to the solid residue, followed by agitation and then left to sit without agitation. After 24 hours, the solid residue is not dissolved. After one week with periodic agitation, large clumps of solid remains in the flask.

Layering of the Cleaning Solution on the Solid Residue

Materials

Acetic acid as a crude product obtained from an integrated acrylic acid purification unit was used as obtained. Solid residue is obtained from a strainer from a discharge of a pump of a crude MMA product storage tank.

Procedure

The formation of the slurry of Example 5 is formed by gently adding 15.27 g of cleaning solution down the side of a 16 ounce container holding an amount of 20.90 g of solid residue. Example 6 is formed by adding 12.0 g of solid residue to a 16-ounce flask and slowly adding down the side of the flask 51.6 g of cleaning solution. The slow addition of cleaning solution is to mimic the slow addition of cleaning solution to a tank.

Examples 5 and 6

Figure 5:
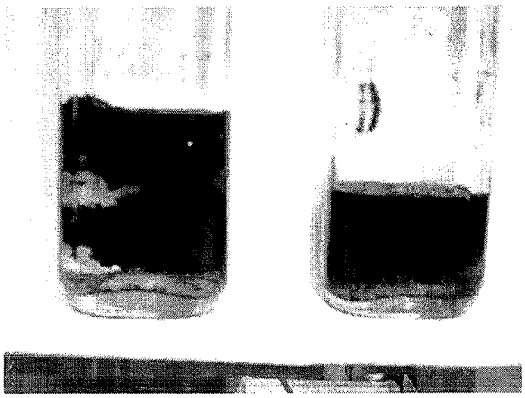
FIG. 5 is a photo of Examples 5 and 6.
Figure 6:
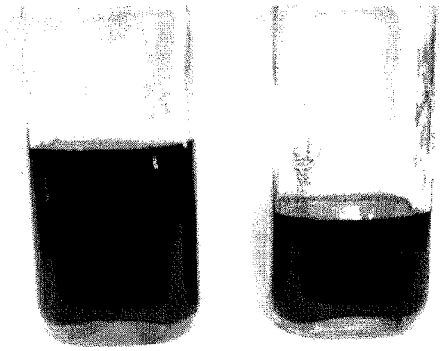
FIG. 6 is a photo of Examples 5 and 6 after 4 hours from the addition of cleaning solution.
Figure 7:
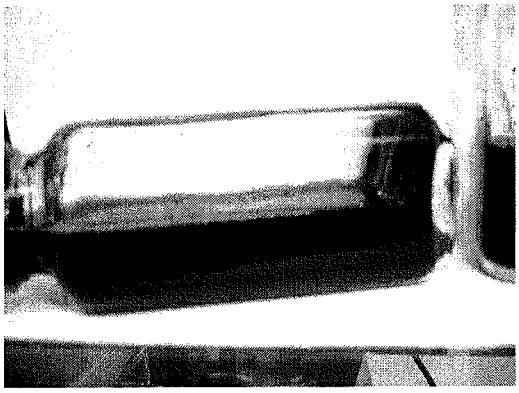
FIG. 7 is a photo of Example 5.
Figure 8:
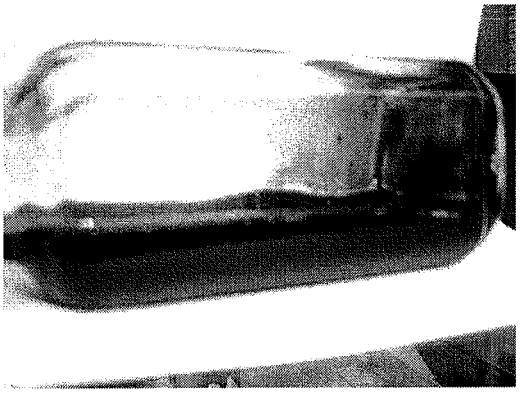
FIG. 8 is a photo of Example 5 after 24-48 hours from the addition of the cleaning solution.

Example 5 uses a 0.73:1 ratio (cleaning solution: solid residue) and Example 6 uses a 4.3:1 ratio. FIG. 5 is a photo of Examples 5 and 6 (from left to right, i.e., Example 5 is on the left and Example 6 is on the right) after the cleaning solution was added to the solid residue. FIG. 6 is a photo of Examples 5 and 6 (from left to right) after 48 hours from the time of the addition of cleaning solution and the solid residue appears to be visibly solubilized. FIG. 7 is a photo taken of Example 5 immediately after the addition of cleaning solution upon tilting and rotating. FIG. 8 is a photo of Example 5 taken after 24-48 hours and shows the solid residue is effectively dissolved into the cleaning solution and the bottom of the jar is essentially free from solid residue.

What is claimed is:

1. A method for removing solid residue from equipment used in the processing of (meth)acrylic acid or esters, comprising the steps of:

dissolving the solid residue in a cleaning solution comprising 90 wt % or more of an organic carboxylic acid having 2-10 carbon atoms to produce a solid residue slurry; and removing the solid residue slurry from the equipment.

2. The method of claim 1 wherein the organic carboxylic acid is acetic acid, propionic acid, acetic anhydride, propionic anhydride or combinations thereof.

3. The method of claim 1 wherein the cleaning solution has a pKa from 3 to 7.

4. The method of claim 1 wherein the cleaning solution to solid residue is in a ratio of 1 to 1.

5. The method of claim 1 wherein the cleaning solution to solid residue is in a ratio of 2 to 1.

6. The method of claim 1 further comprising soaking the solid residue in the cleaning solution for 24 hours before removing the solid residue slurry.

7. The method of claim 1 wherein the cleaning solution further comprises 3-5 wt % of acrylic acid and 1-2 wt % of water.

8. The method of claim 1 wherein the dissolving solid residue in the cleaning solution comprises agitating the solid residue.

9. The method of claim 1 wherein the dissolving and removing steps are repeated after 24 hours.

10. The method of claim 1 wherein the dissolving step is carried out at temperatures less than 100° C. and at atmospheric pressure.

11. The method of claim 1 wherein the dissolving step is carried out at temperatures less than 40° C. and at atmospheric pressure.

12. The method of claim 1 wherein the dissolving step is carried out at room temperature and at atmospheric pressure.

13. The method of claim 1 wherein the cleaning solution comprises from 90 wt % to 95 wt % of the organic carboxylic acid having 2-10 carbon atoms.

14. A method for removing solid residue from equipment used in the processing of (meth)acrylic acid or esters, comprising the steps of:

dissolving the solid residue in a composition consisting of 100 wt % of an organic carboxylic acid to produce a solid residue slurry wherein the organtic caroxylic acid is acetic acid, propionic acid, acetic anhydrine, propionic anhydride, or combinations thereof; and removing the solid residue slurry from the equipment.

* * * * *